United States Patent [19]

Flodman et al.

[11] Patent Number: 4,541,192

[45] Date of Patent: Sep. 17, 1985

[54] HINGE DEVICE FOR FIREARMS

[75] Inventors: Rune Flodman; Lennart Flodman; Bertil Flodman, all of Nora, Sweden

[73] Assignee: Flodman Guns KB, Nora, Sweden

[21] Appl. No.: 531,828

[22] PCT Filed: Dec. 14, 1982

[86] PCT No.: PCT/SE82/00425

§ 371 Date: Aug. 12, 1983

§ 102(e) Date: Aug. 12, 1983

[87] PCT Pub. No.: WO83/02154

PCT Pub. Date: Jun. 23, 1983

[30] Foreign Application Priority Data

Dec. 14, 1981 [SE] Sweden ..... 8107457

[51] Int. Cl.[4] ..... F41C 11/08

[52] U.S. Cl. ..... 42/40; 42/75 D

[58] Field of Search ..... 42/40, 75 B, 75 C, 75 D

[56] References Cited

U.S. PATENT DOCUMENTS 804,349 11/1905 Stendebach ..... 42/40
1,924,656 8/1933 Ribe ..... 42/40
4,199,886 4/1980 Deuring ..... 42/40

FOREIGN PATENT DOCUMENTS 906673 1/1946 France .
480058 4/1953 Italy ..... 42/40
363893 11/1974 Sweden .

*Primary Examiner*—Charles T. Jordan
*Assistant Examiner*—Ted L. Parr
*Attorney, Agent, or Firm*—Hill, Van Santen, Steadman & Simpson

[57] ABSTRACT

A hinge device for break-open type firearm comprises two pair of arcuate ridges on the breech slidably received in complementary grooves formed in parallel sidewalls of a receiver. One pair of ridges and complementary grooves is located forwardly of the hinge axis, with one ridge and its associated groove on each side of the ridge, and the other pair of the ridges and complementary grooves is located rearwardly of the hinge axis. In the closed position of the firearm, the ridges and grooves are generally upright, so that their flanks or sidewalls include a large angle with the line of action of the recoil forces.

7 Claims, 3 Drawing Figures

HINGE DEVICE FOR FIREARMS

BACKGROUND OF THE INVENTION (a) Field Of The Invention:

This invention relates to firearms of the break-open type, that is, firearms in which the action is opened by breaking the barrel assembly including the breech about a transverse hinge axis relative to a receiver attached to the butt and having a pair of longitudinal side walls accommodating the breech between them and pivotally connected with the breech by a hinge device. More particularly, the invention is concerned with the hinge device.

(b) Prior Art:

Different forms of hinge devices for break-open firearms are known in the art. The predominant form includes a pivot pin or trunnions defining the hinge axis and sometimes associated with lugs or other elements providing additional surfaces aiding in carrying the recoil forces. Even if such additional surfaces are present, the combined area of the surfaces carrying the recoil forces is relatively small with this form, which also requires a foregrip fitting to hold the hinge device together.

In view of the tendency to use more powerful cartridges, and the increased recoil forces resulting therefrom, a demand for sturdier hinge devices has developed.

Attempts have been made to provide sturdier hinge devices. SE-B-363 893 illustrates an example of an improved hinge device, which comprises semi-circular ridges on the receiver side walls slidably received in complementary grooves formed on the lateral faces of the breech. In a modification of this form, the ridges are formed on the lateral faces of the breech, while the grooves are formed on the inner sides of the receiver side walls.

While the above-mentioned form is advantageous in some respects, it is unsatisfactory is that it does not lend itself to economical production of the receiver in monoblock form and in that its ability to carry heavy recoil forces is insufficient. Moreover, it does not facilitate assembly and disassembly of the main parts of the firearm.

SUMMARY OF THE INVENTION

The object of the present invention is to alleviate the above-mentioned disadvantages and provide a firearm hinge device which is easy to make, assembly and disassemble and which is sturdy and capable of efficiently carrying heavy recoil forces.

In a firearm embodying the invention, the surfaces carrying the recoil forces can readily be dimensioned and oriented so as to withstand the recoil forces efficiently, even after extended use of very powerful cartridges. Moreover, when the main parts of the forearm are being assembled or separated from one another, two parts of the hinge device spaced by a large distance simultaneously guide the relatively moving elements and thereby greatly facilitate the manipulation of the main parts. A further advantage is that no foregrip fitting is required to hold the hinge device together.

The invention will be more readily understood from the following detailed description of an exemplary embodiment, reference being had to the accompanying drawings.

ON THE DRAWINGS

AS SHOWN IN THE DRAWINGS

Figure 3:
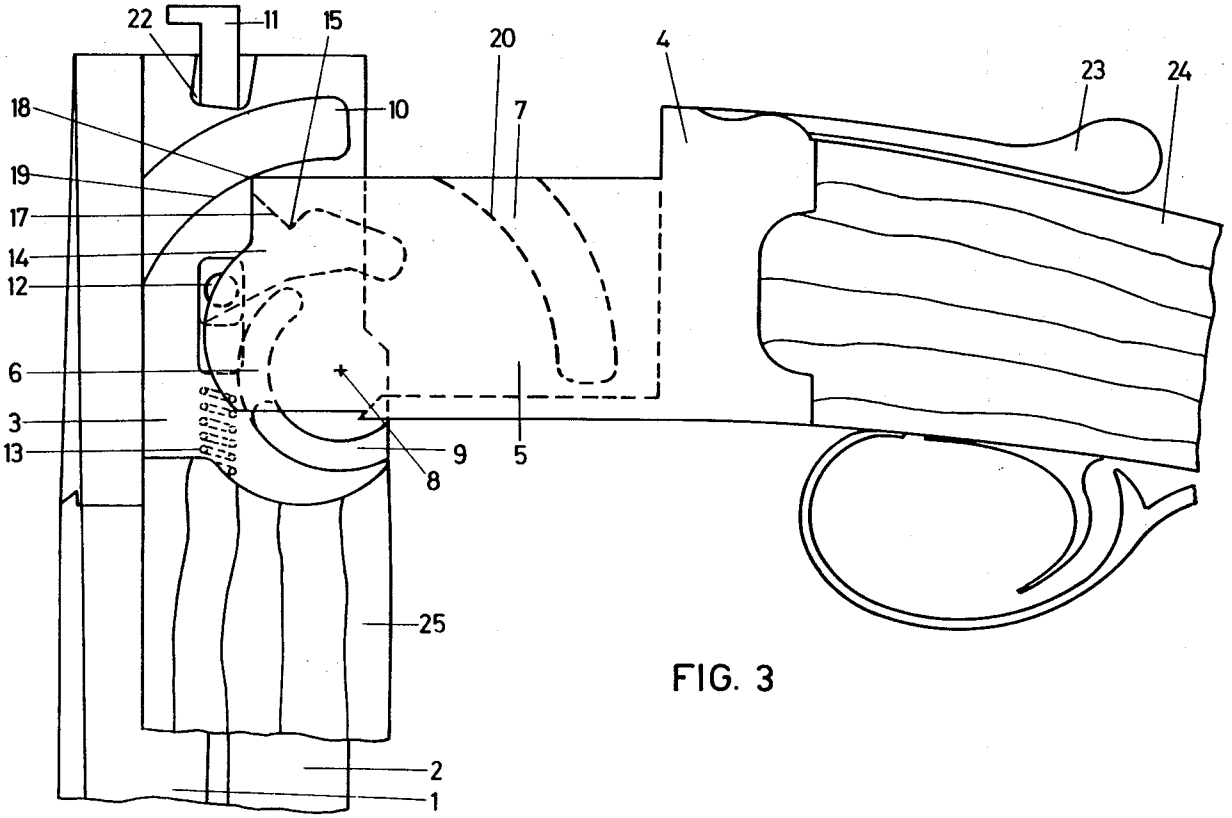

As shown in FIG. 3, the firearm is a double-barrelled shotgun of the over/under type, the two barrels 1 and 2 of which are secured to a breech 3 to form therewith a barrel assembly. A foregrip 25, only partially shown in FIG. 3, also forms part of the barrel assembly. A receiver 4 secured to the butt 24 (also only partially shown) comprises a pair of parellel longitudinal side walls 5, only one of which is shown in the drawings. The receiver 4 pivotally mounts the breech 3 by means of a hinge device which is described in greater detail. Since the invention is primarily concerned with the hinge device and elements closely associated with it, several components of the action of the firearm have been omitted from the drawings. In addition, the following description is limited substantially to one side of the breech 3 and the receiver 4, it being understood that both the breech and the receiver are generally symmetrical about a vertical median plane containing the axes of the barrels 1 and 2.

Figure 1:
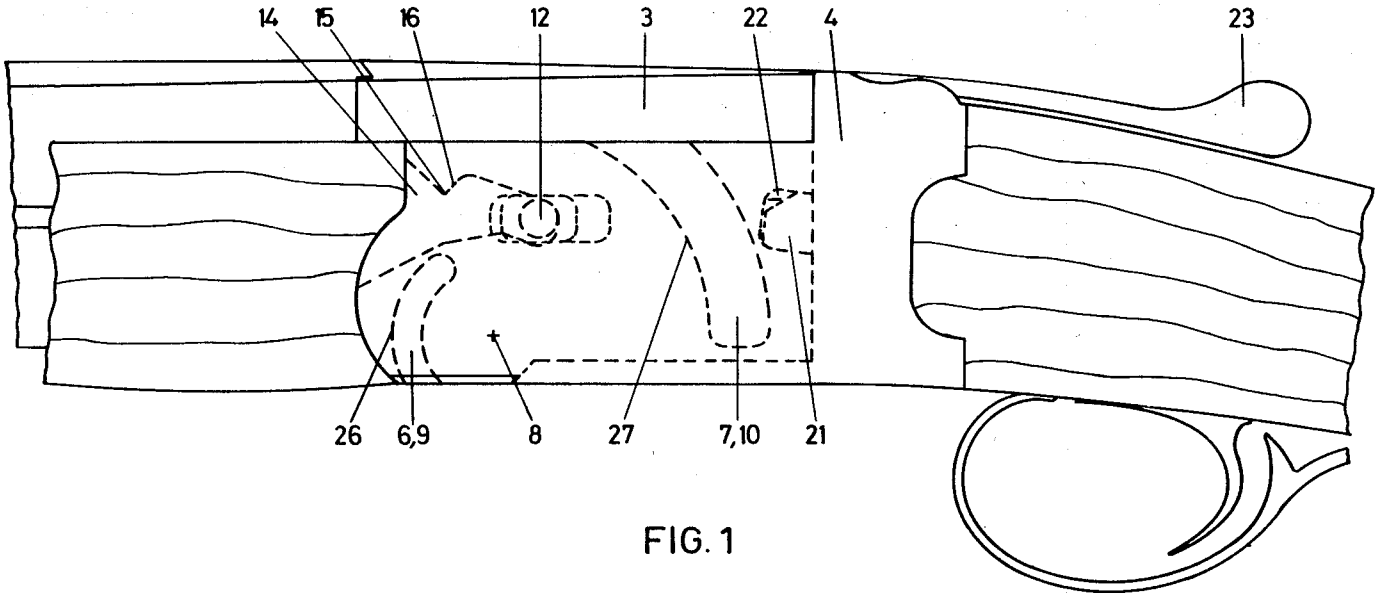
FIG. 1 is a side elevational view of a break-open type firearm incorporating the hinge device of the invention, the firearm being shown in the assembled and closed position.

On its inner side, the receiver side wall 4 is formed with two arcuate grooves, a forward groove 6 and a rear groove 7, both of which are centered on a common transverse axis 8. The cross-section of the grooves is generally rectangular so that their side walls are generally perpendicular to the median plane of the firearm. As clearly apparent from the drawings, the radius of curvature of the rear groove 7 is much larger than that of the forward groove 6. Moreover, the grooves are oriented such that the tangents to the side walls of the grooves are perpendicular to, or include a large acute angle with, the axes of the barrels 1 and 2 when the firearm is in the closed position as shown in FIG. 1. In other words, the grooves 6 and 7 are generally vertical or upright so that the surface area of the side walls of the grooves projected perpendicularly on a transverse plane is only slightly smaller than their circumferential area.

As is also clearly apparent from the drawings, the forward groove 6 is open downwardly at the lower edge of the side wall 5 while the rear goove 7 is open upwardly at the upper edge.

On the lateral face of the breech 3 confronting the grooved inner side of the receiver side wall 5, front and rear ridges 9 and 10 are provided which are complemental in shape to the grooves 6 and 7, respectively, and slidably received therein so that the breech 3, and hence the entire barrel assembly, is pivotally movable relative to the receiver 4 about the axis 8 of the hinge device formed by the interengaging elements 6,7 and 9,10 of the receiver 4 and the breech 3.

Slidably mounted in the breech 3 is a cartridge ejector 11 having a cam follower 12 and urged towards a retracted position by a compression spring 13. In the assembled position of the firearm, the cam follower 12 is located within a recess 14 machined into the inner side of the receiver side wall 5. The upper side wall of the recess 14 forms a camming surface with a cusp 15 and adjoining forward and rear flanks 17 and 16, respectively. The recess 14 is open forwardly at the front edge of the receiver side wall 5.

When the main parts of the firearm, namely, the barrel assembly 1-3 on the one hand and the receiver 4 and the butt 24 on the other hand, are to be assembled the barrel assembly and the receiver are initially held in the relative position shown in FIG. 3. The forward ridge 9 is moved endwise into the forward groove 6 with the forward upper corner 18 of the receiver side wall 5 in engagement with the forward flank 19 of the rear ridge 10; the just-mentioned corner 18 is located at the same radial distance from the hinge axis 8 as the forward side wall 20 of the rear groove 7. The corner 18 thus assists the coacting surfaces of the groove 6 and the ridge 9 in guiding the barrel assembly and the receiver during their relative pivotal movement about the hinge axis 8 until the rear ridge 10 enters the rear groove 7.

Figure 2:
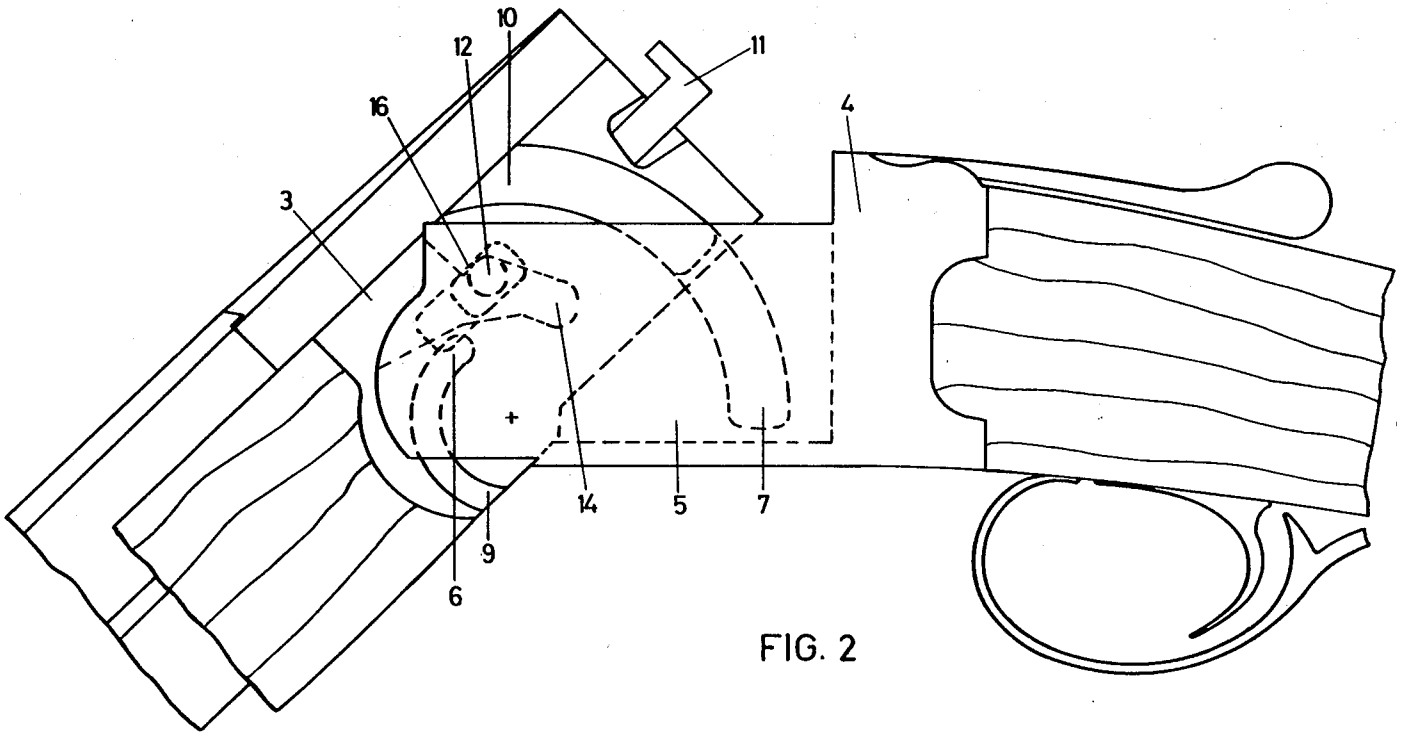
FIGS. 2 and 3 are views similar to FIG. 1 but show the firearm respectively in the broken position and in an initial stage of assembly of the main parts.

During the pivotal movement, the forward flank 17 of the camming surface causes the cartridge ejector 11 to move forwardly against the action of the compression spring 13. When the cam follower 12 passes over the cusp 15, it allows the compression spring 13 to move the cartridge ejector 11 rearwardly to the position shown in FIG. 2.

Continued pivotal movement causes both ridges 9 and 10 to become completely received in their respective complementary grooves 6 and 7 whereupon the barrel assembly 1-3 and the receiver 4 may be locked together by means of a lug 21 which is caused to engage a breech recess 22 by manipulation of a top lever 23 as is well known in the art.

When a cartridge inserted in one of the cartridge chambers of the breech 3 is fired, the longitudinally acting recoil forces will be carried by the interengaging front surfaces 26 and 27 of the grooves 6,7 and ridges 9,10. Because of their location and orientation, these surfaces can be amply dimensioned both lengthwise and widthwise so as to be able to carry efficiently even the recoil forces resulting from use of very powerful cartridges. An important feature of the surfaces 26 and 27 is that they are generally upright, that is, generally transverse to the line of action of the recoil forces, throughout their length.

Opening of the firearm, e.g. for cartridge ejection and/or reloading, is effected by disengaging the locking lug 21 by means of the top lever 23 and allowing the barrel assembly to pivot until the cam follower 12 engages the rear flank 16 of the camming surface. In order that the barrel assembly 1-3 may be separated from the receiver 4, the cartridge ejector 11 has to be depressed to allow the cam follower 12 to move past the cusp 15.

We claim:

1. A firearm of the break-open type, comprising a receiver having longitudinal side walls, a barrel assembly including a breech positioned between the receiver side walls, and a hinge device connecting the barrel assembly to the receiver side walls for pivotal movement about a transverse hinge axis, said hinge device comprising arcuate ridges having a rectangular cross-section and complementary grooves slidably receiving the ridges, said ridges and grooves being centered on the hinge axis and provided respectively on one and the other of the pair of elements constituted by said breech and said receiver side walls, said ridges and grooves comprising on each side of said breech, two ridge segments and complementary grooves, one of said two ridge segments and the complementary groove receiving it being located forwardly of the hinge axis and the other ridge segment and the complementary groove receiving it being located rearwardly of the hinge axis and having a larger radius of curvature than said one ridge segment and said complementary groove receiving it.

2. A firearm according to claim 1, the complementary groove receiving said rear ridge segment having an upwardly open end in said receiver side wall while the complementary groove receiving said forward ridge segment having a downwardly open end, and an upper forward corner region of said receiver side wall engaging the radially inner flank of said rear ridge segment when the firearm is broken to an open position in which said front ridge segment is only partially received in the associated complementary groove and said rear ridge segment is entirely out of the associated complementary groove.

3. A firearm according to claim 1, the circumferential length of each said ridge element is only slightly larger than its chord, and said rear ridge segment and a complementary groove receiving it extending over a major portion of the entire height of respectively said breech and said receiver sidewalls.

4. A firearm according to claim 1, the circumferential length of each said ridge segment is only slightly larger than its chord, the complementary groove receiving said rear ridge segment having an upwardly open end in said receiver side wall while the complementary groove receiving said forward ridge segment having a downwardly open end, and an upper forward corner region of said receiver side wall engaging the radially inner flank of said rear ridge segment when the firearm is broken to an open position in which said front ridge segment is only partially received in the associated complementary groove and said rear ridge segment is entirely out of the associated complementary groove.

5. A firearm according to claim 1, the circumferential length of each said ridge segment is only slightly larger than its chord, said rear ridge segment and the complementary groove receiving it extending over a major portion of the entire height of respectively said breech and said receiver side walls, and the complementary groove receiving said rear ridge segment having an upwardly open end in said receiver side wall while the complementary groove receiving said forward ridge segment having a downwardly open end, and an upper forward corner region of said receiver side wall engaging the radially inner flank of said rear ridge segment when the firearm is broken to an open position in which said front ridge segment is only partially received in the associated complementary groove and said rear ridge segment is entirely out of the associated complementary groove.

6. A firearm according to claim 1, the circumferential length of each said ridge segment is only slightly larger than its chord.

7. A firearm according to claim 1, said rear ridge segment and the complementary groove receiving it extending over a major portion of the entire height of respectively said breech and said receiver side walls.

* * * * *